US010525325B1

(12) United States Patent
Koppel

(10) Patent No.: US 10,525,325 B1
(45) Date of Patent: Jan. 7, 2020

(54) AUTOMATIC SNOWBOARD BINDING

(71) Applicant: Ethan W. Koppel, Sammamish, WA (US)

(72) Inventor: Ethan W. Koppel, Sammamish, WA (US)

( * ) Notice: Subject to any disclaimer, the term of this patent is extended or adjusted under 35 U.S.C. 154(b) by 0 days.

(21) Appl. No.: 16/110,790

(22) Filed: Aug. 23, 2018

(51) Int. Cl.
*A63C 10/00* (2012.01)
*A63C 10/06* (2012.01)
*A63C 10/28* (2012.01)

(52) U.S. Cl.
CPC ..... *A63C 10/06* (2013.01); *A63C 10/28* (2013.01)

(58) Field of Classification Search
CPC ..... A63C 10/02; A63C 10/04; A63C 10/06; A63C 10/28
See application file for complete search history.

(56) References Cited

U.S. PATENT DOCUMENTS 5,556,123 A * 9/1996 Fournier ..... A63C 10/04 280/14.24
6,416,074 B1 7/2002 Maravetz et al.
6,955,362 B2 10/2005 Bazzi
7,503,131 B2 * 3/2009 Nadel ..... A43B 5/0415 36/117.1
7,568,719 B2 * 8/2009 Sauter ..... A63C 10/04 280/619
8,769,844 B2 * 7/2014 Beers ..... A43B 3/0005 36/50.1
2002/0036386 A1 * 3/2002 Murphy ..... A63C 10/10 280/14.23
2004/0113392 A1 * 6/2004 Elkington ..... A63C 10/04 280/617
2007/0045990 A1 3/2007 Cunningham et al.
2011/0057418 A1 * 3/2011 Titterington ..... A63C 10/28 280/617
2013/0328288 A1 * 12/2013 Smith ..... A63C 10/28 280/617
2014/0042728 A1 * 2/2014 Noyes ..... A63C 10/18 280/612
2015/0021881 A1 * 1/2015 Hutchison ..... A63C 10/06 280/621
2018/0310670 A1 * 11/2018 Rovekamp, Jr. ..... A63C 10/28

* cited by examiner

*Primary Examiner* — Brian L Swenson
(74) *Attorney, Agent, or Firm* — Cantor Colburn LLP

(57) ABSTRACT

A binding system includes a base plate and a strap. The strap has a first end and a second end, the first end being affixed relative to the base plate. A strap adjustment assembly is mounted to the base plate. The second end of the strap is connectable to the strap adjustment assembly such that the strap adjustment assembly is operable to at least one of automatically tighten the strap relative to the base plate and automatically loosen the strap relative to the base plate in response to an input signal.

20 Claims, 6 Drawing Sheets

AUTOMATIC SNOWBOARD BINDING

BACKGROUND

Embodiments disclosed herein relate generally to a boot binding system, and more particularly, to a multi-strap boot binding system for snowboard boots having an automatic strap adjustment mechanism.

Existing snowboard binding systems typically utilize two straps for securing a snowboard boot to a snowboard. A first strap is generally used to secure a toe portion of the boot and a second strap is used to secure an ankle portion of the boot. A first end of both the toe strap and the ankle strap is fixed to the snowboard binding so that the strap is movable to pass over the toe or instep of the boot. The second free end of each strap is connectable to a corresponding fastening mechanism disposed on an opposite side of the binding. The two straps are connected to the fastenings mechanism and are adjusted to restrict movement of the boot relative to the snowboard. A two strap binding system may be preferred by users because they are comfortable and provide a high degree of maneuverability and lateral flexibility.

BRIEF DESCRIPTION

According to an embodiment, a binding system includes a base plate and a strap. The strap has a first end and a second end, the first end being affixed relative to the base plate. A strap adjustment assembly is mounted to the base plate. The second end of the strap is connectable to the strap adjustment assembly such that the strap adjustment assembly is operable to at least one of automatically tighten the strap relative to the base plate and automatically loosen the strap relative to the base plate in response to an input signal.

In addition to one or more of the features described above, or as an alternative, in further embodiments the binding system is mounted to a snowboard.

In addition to one or more of the features described above, or as an alternative, in further embodiments the strap adjustment assembly further comprises an actuator and a tightening mechanism movable by the actuator between a released position and a tightened position.

In addition to one or more of the features described above, or as an alternative, in further embodiments the tightening mechanism includes a reel rotatable about an axis between the released position and the tightened position.

In addition to one or more of the features described above, or as an alternative, in further embodiments the tightening mechanism includes a biasing mechanism, the biasing mechanism being translatable along about an axis between the released position and the tightened position.

In addition to one or more of the features described above, or as an alternative, in further embodiments the biasing mechanism further comprises a magnet, and the actuator is operable to generate a magnetic field to move the biasing mechanism in a direction opposite a biasing force of the biasing mechanism.

In addition to one or more of the features described above, or as an alternative, in further embodiments comprising a locking mechanism configured to retain the tightening mechanism at a position between the released position and the tightened position.

In addition to one or more of the features described above, or as an alternative, in further embodiments the tightening mechanism is automatically biased into the released position by a biasing mechanism.

In addition to one or more of the features described above, or as an alternative, in further embodiments comprising an input in communication with the actuator.

In addition to one or more of the features described above, or as an alternative, in further embodiments the input is operable to move the tightening mechanism in both a first direction and a second direction to tighten and loosen the strap.

In addition to one or more of the features described above, or as an alternative, in further embodiments the actuator is continuously operated in response to application of a continuous force to the input.

In addition to one or more of the features described above, or as an alternative, in further embodiments the actuator is configured to automatically move the tightening mechanism between the tightened position and the released position in response to actuation of the input.

In addition to one or more of the features described above, or as an alternative, in further embodiments the actuator is initiate movement of the tightening mechanism in response to a first input signal and cease movement of the tightening mechanism in response to a second input signal.

In addition to one or more of the features described above, or as an alternative, in further embodiments the first input signal and the second input signal are generated by a single input.

In addition to one or more of the features described above, or as an alternative, in further embodiments comprising another strap having a first end and a second end, the first end of the another strap being affixed to the base plate. The second end of the another strap is connectable to the strap adjustment assembly such that the strap adjustment assembly is operable to at least one of automatically tighten the another strap relative to the base plate and automatically loosen the another strap relative to the base plate in response to the input signal.

According to another embodiment, a method of automatically adjusting a strap relative to a boot binding includes generating an input signal via an input device, communicating the input signal to an actuator, and moving a tightening mechanism operably coupled to the strap and the actuator in response to the input signal.

In addition to one or more of the features described above, or as an alternative, in further embodiments generating an input signal includes applying a continuous force to an input device.

In addition to one or more of the features described above, or as an alternative, in further embodiments the actuator continuously moves the strap while the continuous force is applied to the input device.

In addition to one or more of the features described above, or as an alternative, in further embodiments moving the tightening mechanism includes rotating the tightening mechanism about an axis.

In addition to one or more of the features described above, or as an alternative, in further embodiments moving the tightening mechanism includes translating the tightening mechanism along an axis.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
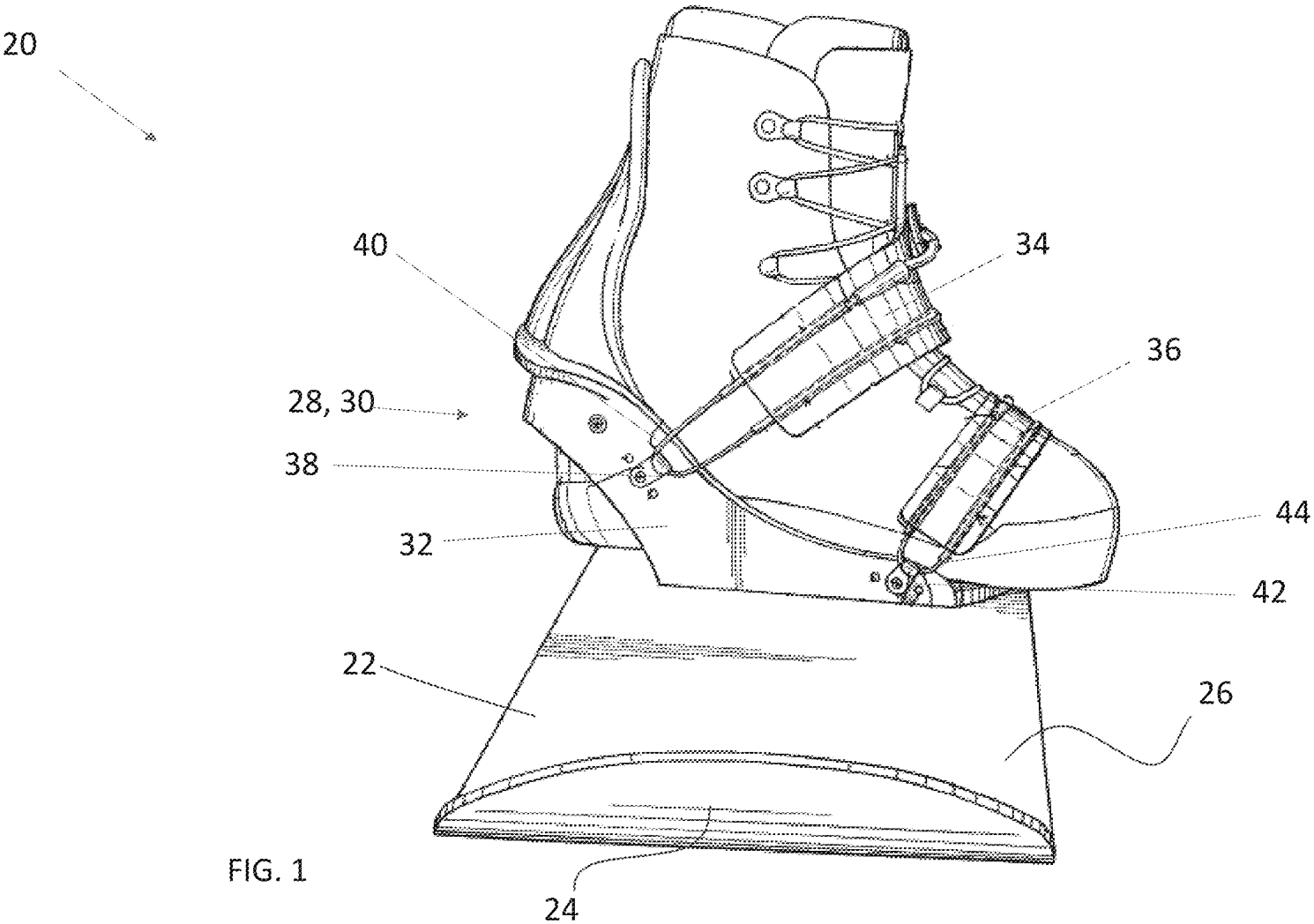
FIG. 1 is a perspective view of an example of a snowboard assembly.

With reference now to FIG. 1, an example of a snowboard assembly 20 is shown. The snowboard assembly 20 includes a snowboard 22 having a lower gliding surface 24 configured to contact the ground and an upper surface 26, disposed opposite the gliding surface 24. A binding system 28 is mounted to the snowboard 22, such as to the upper surface 26 thereof. In the illustrated, non-limiting embodiment, the binding system 28 includes a first boot binding 30 and a second boot binding (not shown) mounted at a distance from one another relative to the snowboard 22. However, it should be understood that a binding system 28 including only a single boot binding is within the scope of the disclosure. The first boot binding 30 and the second boot binding typically have substantially similar configurations.

Each boot binding 30 generally includes a base plate 32 affixed to the snowboard 22, an ankle strap 34, and toe strap 36. However, a boot binding 30 having only an ankle strap 34, only a toe strap 36, or other additional straps for securing a boot to the binding 30 are also contemplated herein. In an embodiment, the base plate 32 may be configured to rotate relative to the upper surface 26 of the snowboard 22. In other embodiments, the base plate 32 may be fixedly mounted to the upper surface 26 of the snowboard 22. A first end (not shown) of at least one of the ankle strap 34 and the toe strap 36 is affixed to a side of the base plate 32 or another portion of the boot binding 30. As shown, the boot binding 30 additionally includes an ankle fastening mechanism 38 for receiving a distal end 40 of the ankle strap 34 and tightening the ankle strap 34 relative to the snowboard 22. Similarly, the boot binding 30 includes a toe strap fastening mechanism 42 for receiving a distal end 44 of the toe strap 36 and tightening the toe strap 36 relative to the snowboard 22. It should be understood that the snowboard assembly 20 illustrated and described herein is intended as an example only, and that a snowboard assembly 20 having a binding system 28 of another configuration is also contemplated herein. Further, although a snowboard assembly 20 is described herein, any system having a strap that is selectively tightened and released, such as a binding for skis for example, is also within the scope of the disclosure.

Figure 2:
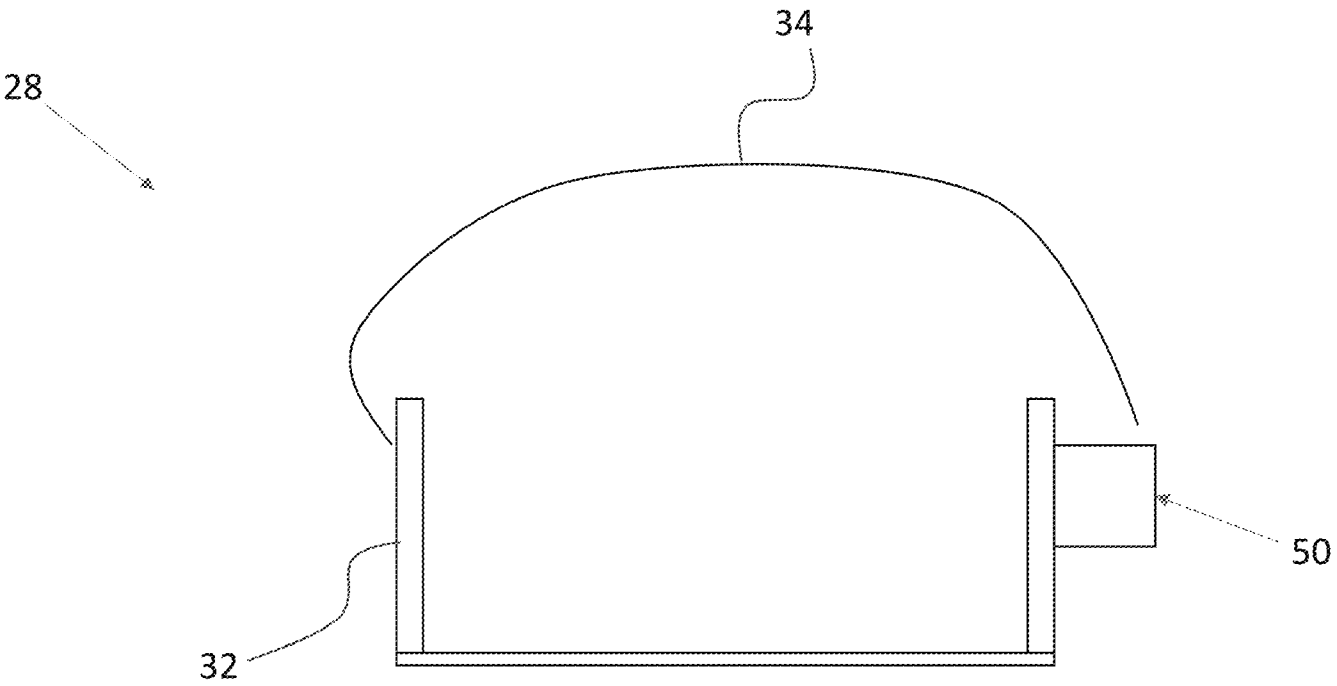
FIG. 2 is an end view of a portion of a boot binding including a strap adjustment assembly according to an embodiment.
Figure 3:
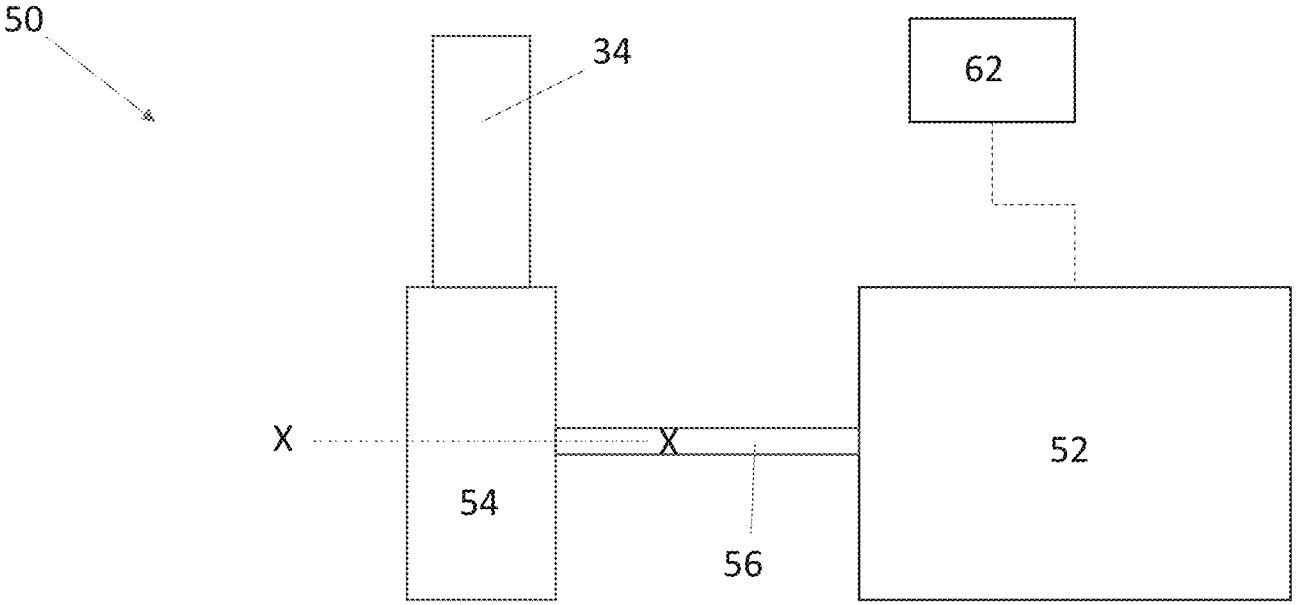
FIG. 3 is a schematic diagram of a strap adjustment assembly according to an embodiment.
Figure 4:
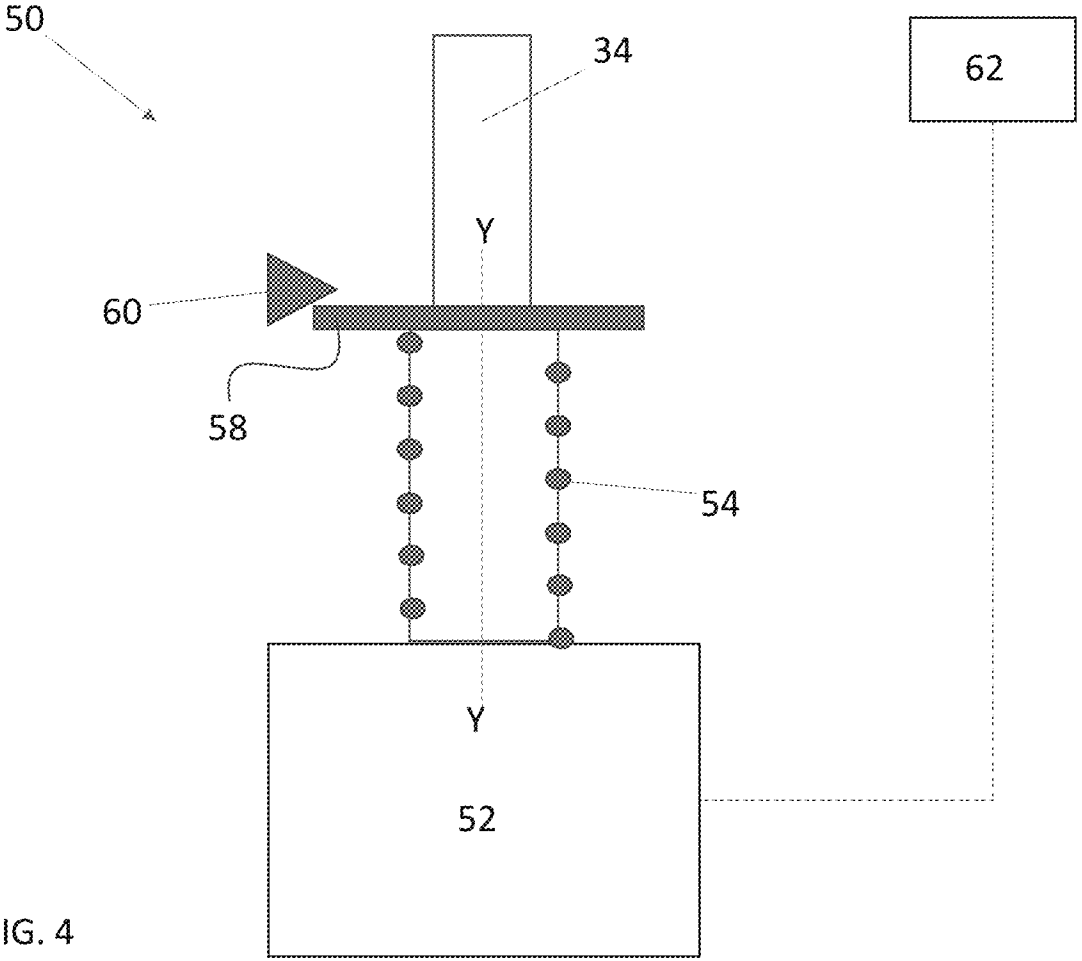
FIG. 4 is a schematic diagram of another strap adjustment assembly according to an embodiment.

In an embodiment, one or more of the straps 34, 36 associated with a boot binding 28 may be automatically tightened or released relative to a corresponding fastening mechanism 38, 42, respectively, in response to an input from a user. With reference now to FIGS. 2-4, in an embodiment, the boot binding system 28 includes a strap adjustment assembly 50 configured to perform this automatic adjustment of one or both of the ankle strap and toe strap 36. For simplicity, the strap adjustment assembly 50 is illustrated and described with respect to the ankle strap 34; however, it should be understood that the system 50 may be adapted for use with the toe strap 36 in place of, or in addition to, the ankle strap 34.

The strap adjustment assembly 50 is located adjacent the opposite side of the boot binding 28 as the fixed end of the ankle straps 34. The strap adjustment assembly 50 includes an actuator 52 connected to a tightening mechanism 54. In the illustrated, non-limiting embodiment of FIG. 3, the tightening mechanism 54 is a reel or spool 54 and is coupled to the actuator 52, such as via a rotational shaft 56 for example. Any suitable type of actuator, such as a motor, a hydraulic actuator, or a pneumatic actuator is contemplated herein. The reel or spool 54 may be used in place of the fastening mechanism 38 previously described. Accordingly, the functionality of the fastening mechanism 38, 42 may be integrated into the strap adjustment assembly 50 configured to perform this automatic adjustment of the ankle strap 34. However, embodiments where the strap adjustment assembly 50 is used in conjunction with a separate fastening mechanism 38 are also within the scope of the disclosure.

The actuator 52 is operable to rotate the reel 54 about its axis X between a first, released position and a second tightened position. In the released position, a free end 40 of the strap 34 may be separable from the reel 54. Alternatively, in embodiments where the free end 40 of the strap 34 is permanently affixed to the reel 54, a minimum portion of the strap 34 is wound about the reel 54 when in the released position. In the released position, the ankle strap applies a minimal force to a boot receivable within the boot binding 30. In the tightened position, a maximum amount of the strap 34 is wound about the reel 54. The maximum amount of the strap 34 that can be wound about the reel 54 may vary based on at least one of the length of the strap 34 and a maximum allowable force or pressure that the strap 34 can apply to a boot within the binding 30, such as based on a user's comfort level for example.

The reel 54 is rotated by the actuator 52 between the first released position and the second tightened position in at least a first direction. When the reel 54 is rotated about the axis X in the first direction, the strap 34 is wound about a periphery of the reel 54, thereby removing slack present in the strap 34 between the fixed end of the strap 34 and the reel 54. Accordingly, rotation of the reel 54 in the first direction effectively "tightens" the strap 34 relative to the boot binding 30. The actuator 52 may additionally be operable to rotate the reel 54 about its axis X in a second opposite direction. When rotated in the second direction, the strap 34 is unwound from the reel 54, thereby releasing material from the reel 54 to increase the overall length of the strap 34 extending between the fixed end of the strap 34 and the reel 54. However, in other embodiments, a biasing mechanism (not shown) may be coupled to the reel 54. Rotation of the reel in the first direction may oppose a biasing force of the biasing mechanism. As a result, the biasing force of the biasing mechanism may be used to rotate the reel 54 in the second direction to release or loosen the strap 34 relative to the boot binding 30.

With reference now to FIG. 4, in another embodiment, the tightening mechanism 54 includes a biasing mechanism, such as a coil spring for example, configured to couple to the free end 40 of the strap 34. The actuator 52 is operably coupled to the biasing mechanism 54 and is configured to move the biasing mechanism 54 against its biasing force to transform the biasing mechanism 54 between a first released position and a second tightened position. In an embodiment, the biasing mechanism includes a magnet 58 mounted thereto, such as to a distal end thereof. However, it should be understood that the magnet 58, may be mounted at another position relative to the biasing mechanism 54. The actuator 52 may include an electromagnet or solenoid that is selectively powered to generate a magnetic field and attract the magnet 58 connected to the biasing mechanism 54. The interaction between the magnetic field of the magnet 58 and the magnetic field of the actuator 52 causes the biasing mechanism 54 to transition between the released and tightened positions. Although the biasing mechanism 54 is illustrated as translating along axis Y, in other embodiments, the biasing mechanism may be configured to rotate about an axis in response to the magnetic field generated by the actuator 52.

As the biasing mechanism 54 is compressed due to attraction between the magnetic fields of the magnet 58 and the electromagnet, the strap 34 will tighten relative to the boot binding 30 to secure a portion of a boot within the binding 30. In an embodiment, the strap adjustment assembly 50 may additionally include a locking mechanism, illustrated schematically at 60, configured to retain the biasing mechanism 54 at any desired position between the tightened and released positions. The locking mechanism 60 may be movable by the user, or alternatively, may be configured to automatically engage the tightening mechanism, such as when operation of the actuator 52 ceases for example.

As shown, one or more inputs 62 are configured to communicate with the actuator 52 to control operation of the actuator 52, and therefore movement of the tightening mechanism 54 to effectively tighten or release the strap 34. In an embodiment, such as where the tightening mechanism 54 is a rotatable reel for example, a single input 62 may be operable to move the tightening mechanism 54 in both the first direction and the second direction. However, in other embodiments, the strap adjustment assembly 50 may include a first input associated with movement of the tightening mechanism 54 in the first direction and a second input, distinct from the first input, associated with movement of the tightening mechanism 54 in the second direction.

The actuator 52 is automatically operable in response to a signal generated by the one or more inputs 62. In an embodiment, the actuator 52 is configured to alter the position or configuration of the tightening mechanism 54, such as by rotation or translation about a corresponding axis, only when a force is applied to the input 62. Accordingly, a continuous force should be applied to the input 62 to continuously move the tightening mechanism 54 until a desired tightness or looseness of the strap 34 is achieved. In another embodiment, the tightening mechanism 54 may be moved completely between the released position and the tightened position in response to a single pulse provided to an input 62. In yet another embodiment, movement of the tightening mechanism 54 between the released position and the tightened position may be initiated in response to receipt of a first input signal from the one or more inputs 62 and stopped in response to a second input signal from either the same input or a different input 62.

Figure 5:
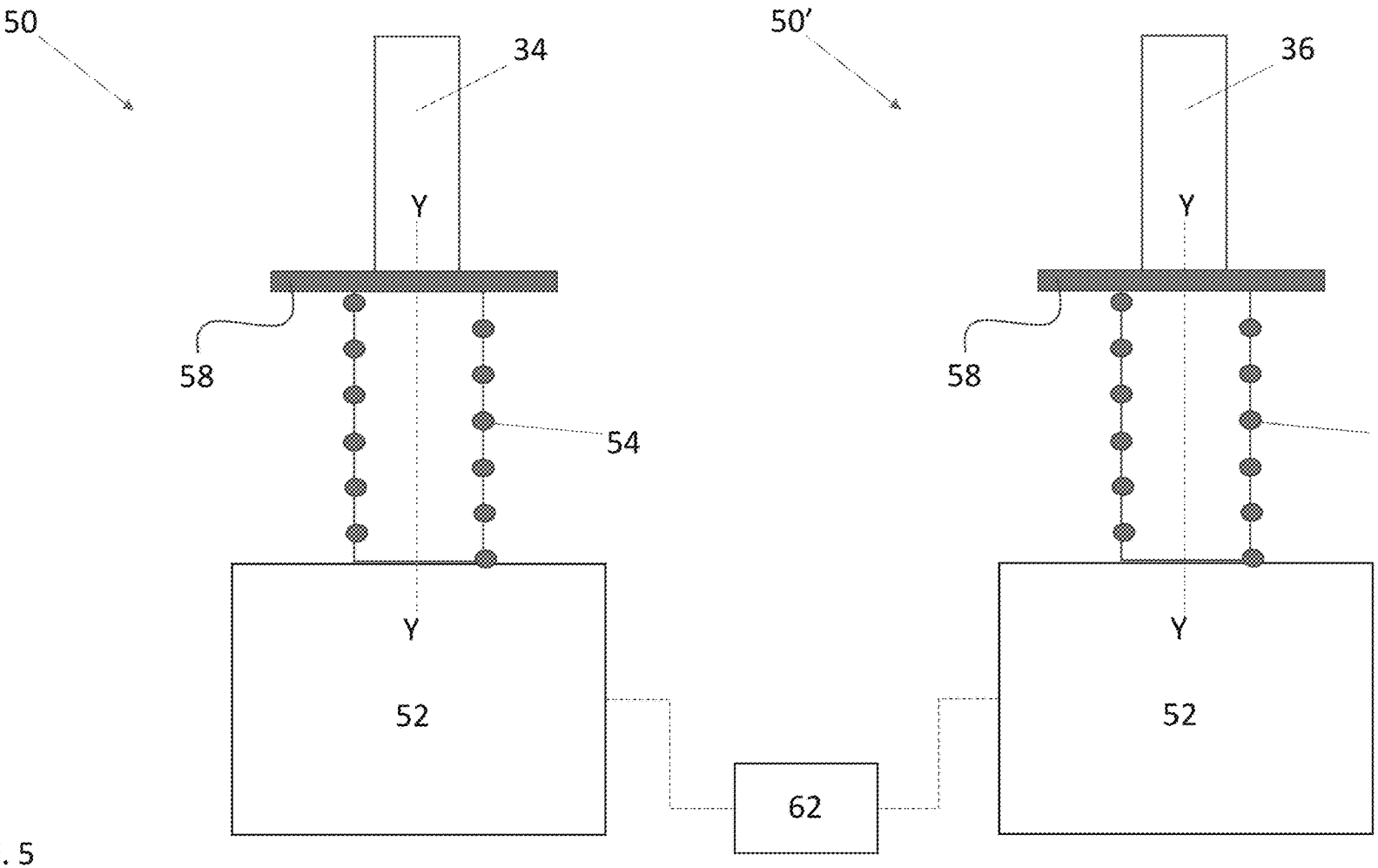
FIG. 5 is a schematic diagram of a first and second strap adjustment assembly of a boot binding according to an embodiment.

As previously mentioned, the strap adjustment assembly 50 of FIGS. 2-4, is illustrated and described with respect to the ankle strap 34 for ease of understanding. With reference now to FIG. 5, in an embodiment a boot binding 30 may include a first strap adjustment assembly 50 configured to adjust the ankle strap 34 and a second strap adjustment assembly 50; configured to adjust the toe strap 36. The first and second strap adjustment assemblies 50, 50' may have the same configuration or different configurations. Further, the first and second strap adjustment assemblies 50, 50' may be operable in response to different inputs 62, such that the first and second strap adjustment assemblies 50, 50' are two independent systems mounted to the same boot binding 30. Alternatively, the first and second strap adjustment assemblies 50, 50' may be operable in response to the same input 62.

Figure 6:
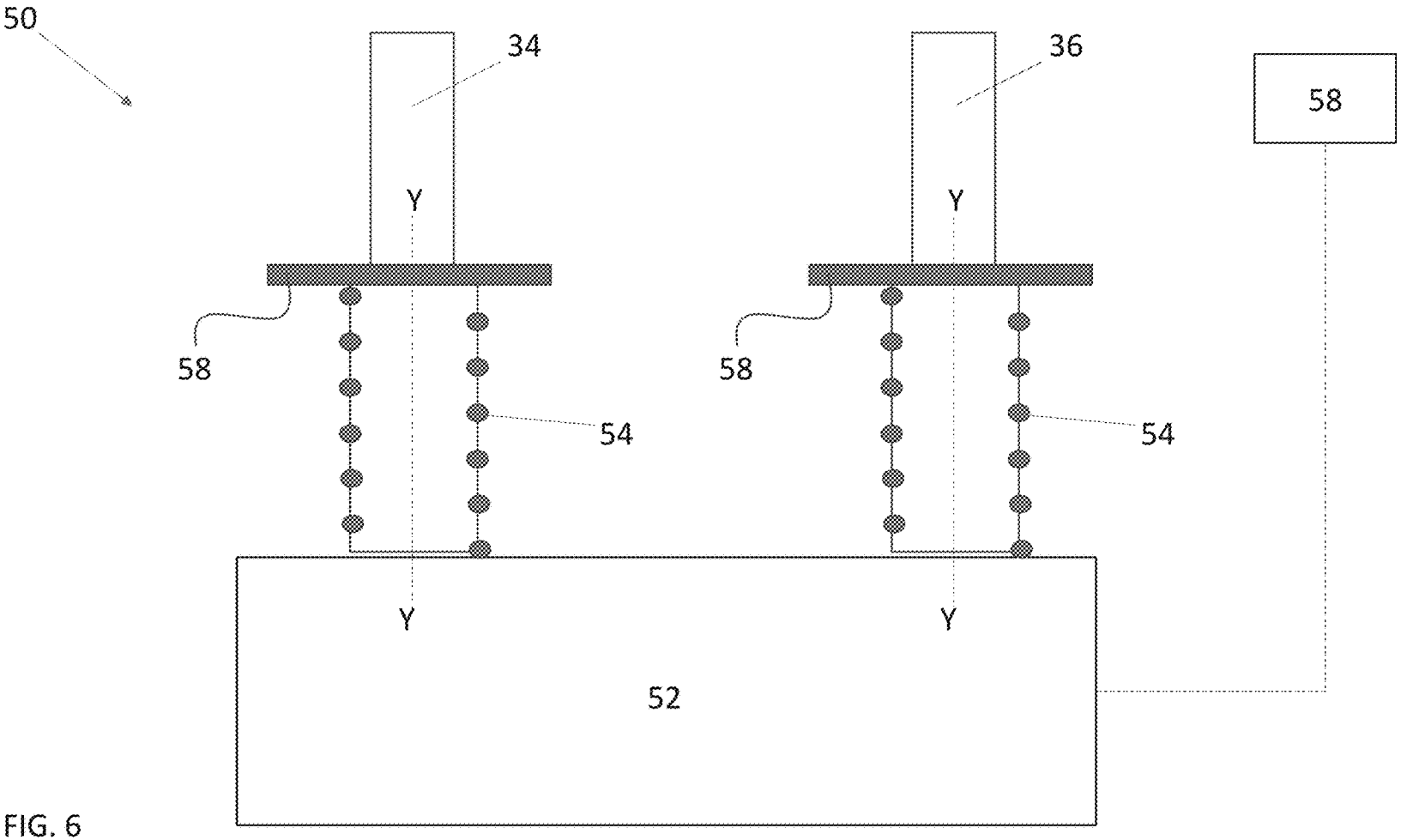
FIG. 6 is another schematic diagram of another of first and second strap adjustment assembly of a boot binding according to an embodiment.

In another embodiment, the first and second strap adjustment assemblies 50, 50' may be at least partially integrated with one another. For example, as shown in FIG. 5, the first and second strap adjustment assemblies 50, 50' may be operable in response to the same one or more inputs 62. With respect to FIG. 6, the first and second strap adjustment assemblies 50, 50' may be coupled via use of a single actuator 52. As shown, a single actuator may be used to operate the tightening mechanism 54 of the first strap adjustment assembly and the tightening mechanism of the second strap adjustment assembly 50' simultaneously and in response to a single input signal.

A strap adjustment assembly 50 as illustrated and described herein allows a user to easily and automatically control a tightness of one or more straps 34, 36 of a boot binding 30. Because the assembly 50 is automatically operable in response to an input, a user need not have the dexterity typically necessary to securely fasten a binding.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A binding system comprising:

a base plate;

a strap having a first end and a second end, the first end of the strap being affixed relative to the base plate; and a strap adjustment assembly mounted to the base plate, the second end of the strap being connectable to the strap adjustment assembly such that the strap adjustment assembly is operable to at least one of automatically tighten the strap relative to the base plate and automatically loosen the strap relative to the base plate in response to an input signal, wherein the strap adjustment assembly includes a biasing mechanism having a biasing force operable to automatically loosen the strap relative to the base plate.

2. The binding system of claim 1, wherein the binding system is mounted to a snowboard.

3. The binding assembly of claim 1, wherein the strap adjustment assembly further comprises:

an actuator; and a tightening mechanism movable by the actuator between a released position and a tightened position.

4. The binding assembly of claim 3, wherein the tightening mechanism includes a reel rotatable about an axis between the released position and the tightened position.

5. The binding assembly of claim 3, wherein the biasing mechanism is a portion of the tightening mechanism, the biasing mechanism being translatable along about an axis between the released position and the tightened position.

6. The binding assembly of claim 5, wherein the biasing mechanism further comprises a magnet, and the actuator is operable to generate a magnetic field to move the biasing mechanism in a direction opposite a biasing force of the biasing mechanism.

7. The binding assembly of claim 3, further comprising a locking mechanism configured to retain the tightening mechanism at a position between the released position and the tightened position.

8. The binding assembly of claim 3, wherein the tightening mechanism is automatically biased into the released position by the biasing mechanism.

9. The binding assembly of claim 3, further comprising an input in communication with the actuator.

10. The binding assembly of claim 9, wherein the input is operable to move the tightening mechanism in both a first direction and a second direction to tighten and loosen the strap.

11. The binding assembly of claim 9, wherein the actuator is continuously operated in response to application of a continuous force to the input.

12. The binding assembly of claim 9, wherein the actuator is configured to automatically move the tightening mechanism between the tightened position and the released position in response to actuation of the input.

13. The binding assembly of claim 9, wherein the actuator initiates movement of the tightening mechanism in response to a first input signal and cease movement of the tightening mechanism in response to a second input signal.

14. The binding assembly of claim 13, wherein the first input signal and the second input signal are generated by a single input.

15. The binding assembly of claim 1, further comprising another strap having a first end and a second end, the first end of the another strap being affixed to the base plate, wherein the second end of the another strap is connectable to the strap adjustment assembly such that the strap adjustment assembly is operable to at least one of automatically tighten the another strap relative to the base plate and automatically loosen the another strap relative to the base plate in response to the input signal.

16. A method of automatically adjusting a strap relative to a boot binding comprising:

generating an input signal via an input device;

communicating the input signal to an actuator; and moving a tightening mechanism operably coupled to the strap and the actuator in response to the input signal, wherein during loosening of the strap relative to the boot binding, a biasing force of a biasing mechanism associated with the tightening mechanism moves the tightening mechanism.

17. The method of claim 16, wherein generating an input signal includes applying a continuous force to an input device.

18. The method of claim 17, wherein the actuator continuously moves the strap while the continuous force is applied to the input device.

19. The method of claim 16, wherein moving the tightening mechanism includes rotating the tightening mechanism about an axis.

20. The method of claim 16, wherein moving the tightening mechanism includes translating the tightening mechanism along an axis.

* * * * *